US007253558B2

(12) United States Patent
Hwang

(10) Patent No.: US 7,253,558 B2
(45) Date of Patent: Aug. 7, 2007

(54) PLASMA DISPLAY PANEL PROVIDED WITH PAIRS OF TRAPEZOIDAL SHAPED TRANSPARENT ELECTRODES

(75) Inventor: Tae Su Hwang, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/912,224

(22) Filed: Aug. 6, 2004

(65) Prior Publication Data

US 2005/0029945 A1 Feb. 10, 2005

(30) Foreign Application Priority Data

Aug. 8, 2003 (KR) ..... 10-2003-0054962

(51) Int. Cl.
*H01J 17/49* (2006.01)

(52) U.S. Cl. ..... 313/583; 313/582; 313/585

(58) Field of Classification Search ..... 313/582–587
See application file for complete search history.

(56) References Cited

U.S. PATENT DOCUMENTS

| | | | | |
|---|---|---|---|---|
| 3,975,725 | A | 8/1976 | Ogle | |
| 5,640,068 | A * | 6/1997 | Amemiya | 313/582 |
| 5,877,734 | A * | 3/1999 | Amemiya | 345/60 |
| 6,195,070 | B1 | 2/2001 | Shinoda et al. | |
| 6,348,762 | B1 * | 2/2002 | Nunomura et al. | 313/582 |
| 6,424,095 | B1 * | 7/2002 | Hirao et al. | 315/169.4 |
| 6,452,333 | B1 * | 9/2002 | Torisaki et al. | 313/586 |
| 6,838,825 | B2 * | 1/2005 | Shiiki et al. | 313/582 |
| 2002/0021090 | A1 | 2/2002 | Sano et al. | |
| 2002/0063524 | A1 * | 5/2002 | Nakamura et al. | 313/582 |
| 2004/0070340 | A1 * | 4/2004 | Araki et al. | 313/582 |
| 2004/0135507 | A1 * | 7/2004 | Park et al. | 313/582 |

FOREIGN PATENT DOCUMENTS

| | | |
|---|---|---|
| JP | 08-250030 | 9/1996 |
| JP | 11-054047 | 2/1999 |
| JP | 2000-106090 | 4/2000 |
| JP | 2001-325887 | 11/2001 |
| JP | 2002-324488 | 11/2002 |
| JP | 2002-324490 | 11/2002 |
| KR | 1020010004091 | 1/2001 |

OTHER PUBLICATIONS

Chinese Office Action dated Jun. 23, 2006 with English translation.
Japanese Office Action dated Feb. 6, 2007.

* cited by examiner

*Primary Examiner*—Mariceli Santiago
(74) *Attorney, Agent, or Firm*—KED & Associates, LLP

(57) ABSTRACT

A plasma display panel for improving brightness and as reducing power consumption is disclosed. In the plasma display panel, transparent electrodes make a pair at each of discharge cells. Protruded transparent electrodes are protruded from the respective transparent electrodes with a structure in which a square shape is connected to a trapezoidal shape. Connectors connects the protruded transparent electrodes arranged at adjacent discharge cells to each other to be stepped from one end of the protruded transparent electrode positioned at the middle portion of the discharge cell.

22 Claims, 8 Drawing Sheets

PLASMA DISPLAY PANEL PROVIDED WITH PAIRS OF TRAPEZOIDAL SHAPED TRANSPARENT ELECTRODES

This application claims the benefit of Korean Patent Application No. P2003-54962 filed in Korea on Aug. 8, 2003, which is hereby incorporated by reference.

BACKGROUND OF THE INVENTION

1. Field of the Invention

This invention relates to a plasma display panel, and more particularly to a plasma display panel that is adaptive for improving brightness as well as reducing power consumption.

2. Description of the Related Art

Recently, a plasma display panel (PDP) feasible to a manufacturing of a large-dimension panel has been highlighted as a flat panel display device. The PDP usually controls a discharge period of each pixel in accordance with a digital video data to thereby display a picture. The PDP typically includes a three-electrode, alternating current (AC) type PDP that has three electrodes and is driven with an AC voltage as shown in. FIG. 1.

FIG. 1 is a perspective view showing a structure of each cell arranged in a matrix type en a conventional AC type PDP, and FIG. 2 is a plan view showing the sustain electrode pair shown in FIG. 1.

Referring to FIG. 1 and FIG. 2, the conventional PDP includes an upper plate provided with a sustain electrode pair 14 and 16, an upper dielectric layer 18 and a protective film 20 that are sequentially formed on an upper substrate 10, and a lower plate provided with an address electrode 22, a lower dielectric layer 24, barrier ribs 26 and a phosphorous material layer 28 that are sequentially formed on a lower substrate 12. The upper substrate 10 and the lower substrate 12 are spaced in parallel by the barrier ribs 26.

Each of the sustain electrode pair 14 and 16 is comprised of stripe-shaped transparent electrode 14A and 16A having a relatively large width and made from a transparent electrode material (e.g., ITO) to transmit a visible light, and metal electrodes 14B and 16B having a relatively small width to compensate for a resistance component of the transparent electrodes 14A and 16A. In this case, the transparent electrodes 14A and 16A of the sustain electrode pairs 14 and 16 are opposed to each other with having a gap of approximately 60 μm to 80 μm therebetween. The scan electrode 14 is mainly supplied with a scanning signal for a panel scanning and a sustaining signal for a discharge sustaining, whereas the sustain electrode 16 is mainly supplied with a sustaining signal. Electric charges are accumulated in the upper and lower dielectric layers 18 and 24. The protective film 20 prevents a damage of the upper dielectric layer 18 caused by the sputtering to thereby prolong a life of the PDP as well as to improve the emission efficiency of secondary electrons. This protective film 20 is usually made from magnesium oxide (MgO). The address electrode 22 crosses the sustain electrode pair 14 and 16. This address electrode 22 is supplied with an address signal for selecting cells to be displayed. The carrier ribs 26 are formed in parallel to the address electrode 22 to thereby prevent an ultraviolet ray generated the discharge from being leaked into adjacent cells. The phosphorous material layer 28 is coated on the surfaces of the lower dielectric layer 24 and the barrier ribs 26 to generate any one of red, green and blue visible lights. A discharge space is filled with an inactive gas for a gas discharge.

The cell of the PDP having the structure as mentioned above is selected by an opposite discharge between the address electrode 22 and the scan electrode 14, and thereafter sustains the discharge by a surface discharge between the sustain electrode pair 14 and 16. In the PDP cell, the phosphorous material 28 is radiated by an ultraviolet ray generated upon sustain discharge to thereby emit a visible light into the exterior of the cell. In this case, the PDP controls a discharge sustain period, that is, a sustain discharge frequency of the cell in accordance with a video data to thereby implement a gray scale required for an image display.

Such an AC surface-discharge PDP is driven with being divided into a plurality of sub-fields, so as to realize gray levels of a picture. A light-emission having a frequency proportional to a weighting value of a video data is made in each sub-field period to thereby express a gray level. For instance, if it is intended to display a picture of 256 gray levels using an 8-bit video data one frame display interval (i.e., 1/60 second=about 16.7 msec) at each discharge cell 11 is divided into 8 sub-fields SF1 to SF8. Each of the 8 sub-fields SF1 to SF8 again is divided into a reset period, an address period and a sustain period, and the sustain period is given bad a weighting value at a ratio of 1:2:4:8, . . . , :128. Herein, the reset period is a period for initializing the discharge cell; the address period is a period for generating a selective address discharge in accordance with a logical value of a video data; and the sustain period is a period for sustaining a discharge at the discharge cell having generated the address discharge. The reset period and the address period are identically assigned in each sub-field interval.

If electrode widths of the scan electrode 14 and the sustain electrode 16 are defined narrowly in order to reduce power consumption of such a PDP, then a discharge path upon discharge is shortened to thereby limit a light-emission area. Thus, an emission amount of an ultraviolet ray is reduced and hence brightness is deteriorated. On the other hand, if electrode widths of the scan electrode 14 and the sustain electrode 16 are defined widely in order to enhance brightness of the PDP, then a capacitance value rises to increase a discharge current and power consumption.

Furthermore, the conventional PDP is made into a larger dimension screen than other flat panel display (FPD) devices having 40, 50 and 60 inches, etc. Accordingly, in the conventional PDP, a voltage drop caused by an electrode length has a relatively large difference between the middle portion and the peripheral portion of the PDP. Also, since a discharge gas is injected into the interior of the PDP at a lower pressure than the atmospheric pressure, a force applied to the substrates 11 and 16 at the middle portion where the upper/lower substrates 10 and 12 are supported only by the barrier ribs 26 becomes different from that at the peripheral portion where the upper/lower substrates 10 and 12 are joined with each other by a sealant (not shown). As a result, although the conventional PDP has somewhat difference depending upon a size of the panel, it has a brightness difference between the middle portion and the peripheral portion thereof in each of the horizontal direction and the vertical direction to thereby cause a non-display area at which any discharge does not occur.

SUMMARY OF THE INVENTION

Accordingly, it is an object of the present invention to provide a plasma display panel that is adaptive for improving brightness as well as reducing power consumption.

In order to achieve these and other objects of the invention, a plasma display panel according to an embodiment of the present invention includes transparent electrodes making a pair at each of discharge cells; protruded transparent electrodes protruded from the respective transparent electrodes with a structure in which a square shape is connected to a trapezoidal shape; and connectors for connecting the protruded transparent electrodes arranged at adjacent discharge cells to each other to be stepped from one end of the protruded transparent electrode positioned at the middle portion of the discharge cell.

The plasma display panel further includes barrier ribs for separating said adjacent discharge cells; and metal electrodes provided on the transparent electrodes Herein, a distance between the barrier rib and the protruded transparent electrode is in a range of about 10 μm to 50 μm.

The connector is leaned toward the edge of the discharge cell from one end of the protruded transparent electrode.

The plasma display panel further includes a cavity in which the transparent electrode is removed between the protruded transparent electrodes arranged at each of said adjacent discharge cells, said capacity extending over said adjacent discharge cells.

A plasma display panel according to another aspect of the present invention includes transparent electrodes making a pair at each of discharge cells; protruded transparent electrodes protruded from the respective transparent electrodes with a structure in which a square shape is connected to a trapezoidal shape; and connectors for connecting the protruded transparent electrodes to each other at adjacent discharge cells with the same width as a square-shaped portion of the protruded transparent electrode.

The plasma display panel as claimed further includes barrier ribs for separating said adjacent discharge cells; and metal electrodes provided on the transparent electrodes.

The plasma display panel further includes a cavity in which the transparent electrode is removed between the protruded transparent electrodes arranged at each of said adjacent discharge cells, said capacity extending over said adjacent discharge cells.

Herein, a distance between the barrier rib and the protruded transparent electrode is in a range of about 10 μm to 50 μm.

A plasma display panel according to still another aspect of the present invention includes barrier ribs for asymmetrically sectioning a size of red, green and blue discharge cells; transparent electrodes making a pair at each of discharge cells; and protruded transparent electrodes protruded from the respective transparent electrodes with a structure in which a square shape is connected to a trapezoidal shape.

The plasma display panel further includes connectors for connecting the protruded transparent electrodes arranged at each of adjacent discharge cells to each other.

The connector has a smaller width than a square-shaped portion of the protruded transparent electrode.

The connector is leaned toward the edge of the discharge cell from one end of the protruded transparent electrode positioned at the middle portion of the discharge cell.

The connector connects the protruded transparent electrodes to each other at adjacent discharge cells with the same width as a square-shaped portion of the protruded transparent electrode.

The transparent electrode takes a stripe shape.

An angle of a trapezoid-shaped portion of the protruded transparent electrode to the stripe-shaped transparent electrode is different between adjacent discharge cells.

Herein, said angle is reduced in a sequence of the red, green and blue discharge cells.

A distance between the barrier rib and the protruded transparent electrode is in a range of about 10 μm to 50 μm.

A size of the discharge cells is increased in a sequence of the red, green and blue discharge cells.

The plasma display panel further includes a cavity in which the transparent electrode is removed between the protruded transparent electrodes arranged at each of said adjacent discharge cells, said capacity extending over said adjacent discharge cells.

BRIEF DESCRIPTION OF THE DRAWINGS

These and other objects of he invention will be apparent from the following detailed description of the embodiments of the present invention with reference to the accompanying drawings, in which.

DETAILED DESCRIPTION OF TEE PREFERRED EMBODIMENT

Reference will now be made in detail to the preferred embodiments of the present invention, examples of which are illustrated in the accompanying drawings.

Hereinafter, the preferred embodiments of the present invention will be described in detail with reference to FIGS. 3 to 8.

Figure 1:
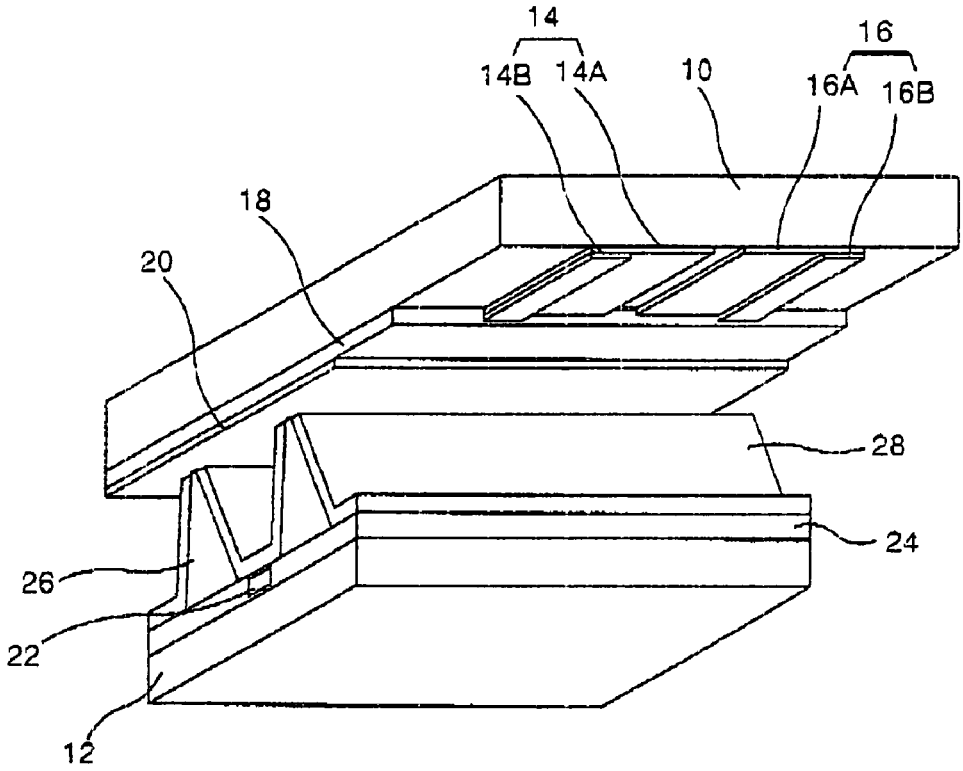
FIG. 1 RELATED ART
FIG. 1 is a perspective view showing a discharge cell structure of a conventional plasma display panel.
Figure 2:
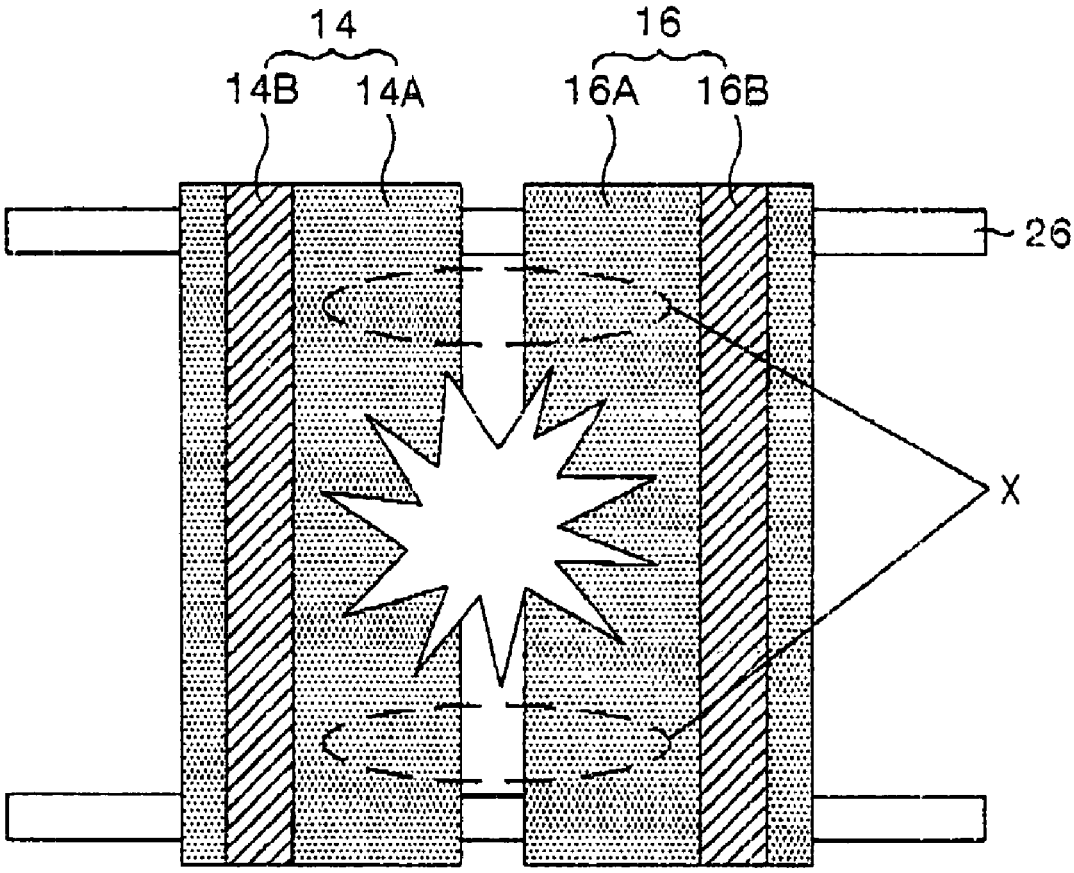
FIG. 2 RELATED ART
FIG. 2 is a plan view illustrating an electrode structure of the plasma display panel shown in FIG. 1.
Figure 3:
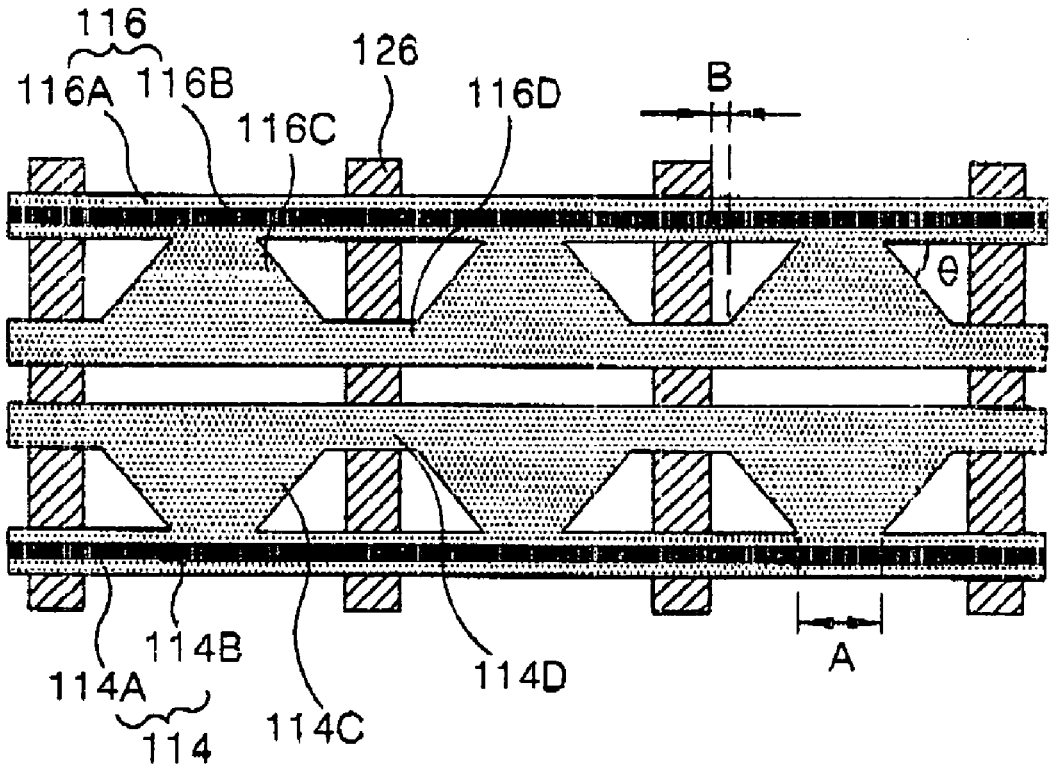
FIG. 3 is a plan view illustrating an electrode structure of a plasma display panel according to a first embodiment of the present invention.

Referring to FIG. 3, a plasma display panel (PDP) according to a first embodiment of the present invention includes an upper plate provided with a sustain electrode pair 114 and 116, an upper dielectric layer (not shown) and a protective film (not shown) that are sequentially formed on an upper substrate (not shown), and a lower plate provided with an address electrode, a lower dielectric layer (not shown), barrier ribs 126 and a phosphorous material layer (not shown) that are sequentially formed on a lower substrate (not shown. The upper substrate and the lower substrate are spaced, in parallel, from each otter by the barrier ribs 126.

The sustain electrode pair 114 and 116 consist of a scan electrode and a sustain electrode. The scan electrode 114 is mainly supplied with a scanning signal for a panel scanning and a sustaining signal for a discharge sustaining, whereas the sustain electrode 116 is mainly supplied with a sustaining signal.

Each of the sustain electrode pair 114 and 116 is comprised of stripe-shaped transparent electrodes 114A and 116A having a relatively large width and made from a transparent electrode material (e.g., ITO) to transmit a visible light, protruded transparent electrodes 114C and 116C protruded in a trapezoidal shape from the transparent electrodes 114A and 116A, connectors 114D and 116D or connecting the protruded transparent electrodes 114C and 116C of adjacent discharge cells to each other, and metal electrodes 114B and 116B having a relatively small width to compensate for resistance components of the transparent electrodes 114A and 116A. In this case, the transparent electrodes 114A and 116A of the sustain electrode pair 114 and 116 are opposed to each other with having a gap of approximately 60 μm to 80 μm therebetween.

The protruded transparent electrodes 114C and 116C remove an ineffective electrode portion at which discharge efficiency within the discharge cell is deteriorated to thereby improve discharge efficiency and brightness, and reduce areas of the respective transparent electrodes 114A and 116A to thereby reduce power consumption. To this end, the protruded transparent electrodes 114C and 116C are protruded in a trapezoidal shape from the respective transparent electrodes 114A and 116A and further protruded in a square shape therefrom. In other words, side surfaces of the protruded transparent electrodes 114C and 116C are spaced, by a gap B of approximately 10 μm to 50 μm, from each other by the barrier ribs 126. The protruded electrodes 114C and 116C have a predetermined width at the middle portions of the respective transparent electrodes 114A and 116A, and have a larger width as they go into a gap portion by which the scan electrode 114 and the sustain electrode 116 are opposed to each other. Thus, in the protruded transparent electrodes 114C and 116C protruded at the middle portions of the respective transparent electrodes 114A and 116A, since a width A of a contact point protruded from the transparent electrodes 114A and 116A is different from a width of the gap portion by which the scan electrode 114 and the sustain electrode 116 are opposed to each other, each of the protruded transparent electrodes 114C and 116C has a predetermined angle θ at the contact point.

The connectors 114D and 116D connect the side surfaces of the respective protruded transparent electrodes 114C and 116C to each other. In other words, the connectors 124D and 116D have a width equal to side surface widths of the respective protruded transparent electrodes 114C and 116C protruded in a square shape, and connect the side surfaces of the protruded transparent electrodes 114C and 116C between adjacent discharge cells to each other. Accordingly, the PDP according to the first embodiment of the present invention is provided with a cavity in which a portion of the transparent electrode at the non-display area corresponding to a corner portion within the discharge cell in the conventional stripe-shaped transparent electrode is removed in a trapezoidal shape.

Each of the connectors 114D and 116D according to the first embodiment of the present invention allows a discharge current to be applied via any at least one of adjacent protruded transparent electrodes 114C and 116C even though any one of the protruded transparent electrodes 124C and 116C is disconnected due to an align substance or an air bubble, etc. upon patterning of a transparent electrode material of a glass working step in the fabrication process of the PDP. In other words, a discharge current is applied from the protruded transparent electrodes 114C and 116C of other discharge cell, via the connectors 114D and 116D, to the protruded transparent electrodes 124C and 116C disconnected by a cell badness caused by an alien material or an air bubble, etc. in the course of the fabrication process of the PDP. Accordingly, the PDP according to the first embodiment of the present invention connects the protruded transparent electrodes 114C and 116C provided within adjacent two discharge cells to each other by the connectors 114D and 116D, thereby prevent a non-discharge caused by a cell badness occurring in the course of the PDP fabrication process.

Meanwhile, electric charges are accumulated in the upper and lower dielectric layers. The protective film prevents a damage of the upper dielectric layer caused by the sputtering to thereby prolong a life of the PDP as well as to improve the emission efficiency of secondary electrons. This protective film is usually made from magnesium oxide (MgO). The address electrode crosses the sustain electrode pair 114 and 116. This address electrode is supplied with an address signal for selecting cells to be displayed. The barrier ribs 126 are formed in parallel to the address electrode 22 to thereby prevent an ultraviolet ray generated by the discharge from being leaked into adjacent cells. The phosphorous material layer is coated on the surfaces of the lower dielectric layer and the barrier ribs 126 to generate any one of red, green and blue visible lights. An internal discharge space is filled with an inactive gas for a gas discharge.

The cell of the PDP having the structure its mentioned above is selected by an opposite discharge between the address electrode and the scan electrode 114, and thereafter sustains the discharge by a surface discharge between the sustain electrode pair 114 and 116. In the PDP cell, the phosphorous material is radiated by an ultraviolet ray generated upon sustain discharge to thereby emit a visible light into the exterior of the cell. As a result, the PDP having the cells displays a picture. In this case, the PDP controls a discharge sustain period, that is, a sustain discharge frequency of the cell in accordance with a video data to thereby implement a gray scale required for an image display.

The PDP according to the first embodiment of the present invention widens the electrode areas of the transparent electrodes 114A and 116A to thereby raise brightness, and removes a portion of the transparent electrodes 114A and 116A from the peripheral portion having discharge efficiency more deteriorated than the middle portion within the discharge cell to thereby reduce power consumption. As a result, the PDP according to the first embodiment of the present invention can not only improve discharge efficiency and brightness, but also it can reduce power consumption.

Figure 4:
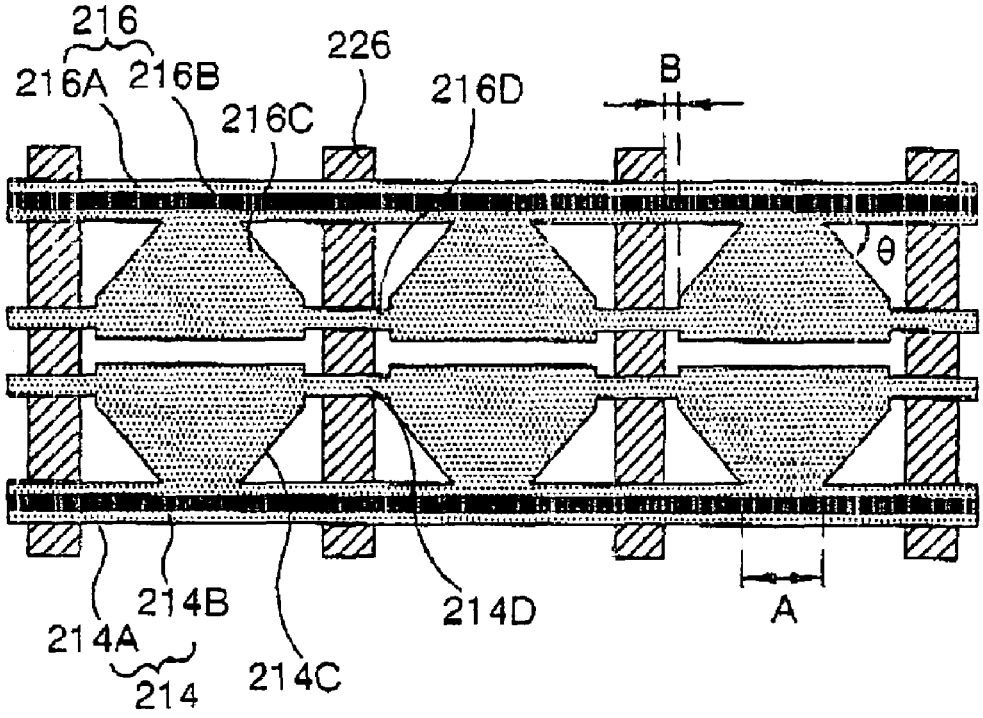
FIG. 4 is a plan view illustrating an electrode structure of a plasma display panel according to a second embodiment of the present invention.

Referring to FIG. 4, a POP according to a second embodiment of the present invention includes connectors 214D and 216D for connecting protruded transparent electrodes 214C and 216C of adjacent discharge cells to each other.

Herein, since other elements, except or the connectors 214D and 216D, are substantially identical to those in the above-mentioned first embodiment, a detailed explanation as to them will be omitted.

The connectors 214D and 216D in the PDP according to the second embodiment of the present invention are leaned inwardly by a predetermined distance at the ends of the respective protruded transparent electrodes 214C and 216C. The connectors 214D and 216D have a smaller width than the side surface widths of the respective protruded transparent electrodes 214C and 216C protruded in a square shapes and connect the protruded transparent electrodes 214C and 216C between adjacent discharge coils. Accordingly, in the PDP according to the second embodiment of the present invention, lengths of the opposite surfaces of the protruded transparent electrodes 214C and 216C which are opposed to each other at each discharge cell are shortened, so that it becomes possible to reduce an amount of a surface discharge occurring between the protruded transparent electrodes 214C and 216C during a reset period, thereby reducing a black brightness.

Each of the connectors 214D and 216D according to the second embodiment of the present invention allows a discharge current to be applied via any at least one of adjacent protruded transparent electrodes 214C and 216C even though only one of the protruded transparent electrodes 214C and 216C is disconnected dug to an alien substance or an air bubble, etc. upon patterning of a transparent electrode material of a glass working step in the fabrication process of the PDP. In other words, a discharge current is applied from the protruded transparent electrodes 214C and 216C of other discharge cell, via the connectors 214D and 216D, to the protruded transparent electrodes 214C and 216C disconnected by ca cell badness caused by an alien substance or an air bubble, etc. in the course of the fabrication process of the PDP. Accordingly, the PDP according to the second embodiment of the present invention connects the protruded transparent electrodes 214C and 216C provided within adjacent two discharge cells to each other by the connectors 214D and 216D, thereby prevent a non-discharge caused by a cell badness occurring in the course of the PDP fabrication process.

The PDP according to the second embodiment of the present invention widens the electrode areas of the transparent electrodes 214A and 216A to thereby raise brightness, and removes a portion of the transparent electrodes 214A and 226A from the peripheral portion having discharge efficiency more deteriorated than the middle portion within the discharge cell to thereby reduce power consumption. As a result, the PDP according to the second embodiment of the present invention can not only improve discharge efficiency and brightness, but also it can reduce power consumption.

Furthermore, the PDP according to the second embodiment of the present invention has a reduced black brightness due to the connectors 214D and 216D to improve a contrast ratio, and connects the protruded transparent electrodes 214C and 216C provided within adjacent two discharge cells to each other due to the connectors 214D and 216D to thereby preventing a non-discharge caused by a cell badness occurring in the course of the fabrication process thereof.

Meanwhile, since light-emission characteristics of red(R), green(G) and blue(B) phosphorous materials 6 in the PDP are different from each other, emission brightness of the discharge cells for implementing red(R), green(G) and blue (B) colors also become different from each other. Particularly, emission brightness of the discharge cell for implementing a green(G) color is higher than that of the discharge cells for implementing red(R) and blue(E) colors, and emission brightness of the discharge cell for implementing a red(R) color is higher than that of the discharge cell for implementing a blue(B) color. Thus, there is raised a problem in that a whole color temperature of the PDP is lowered due to low emission brightness of the discharge cell for implementing a blue(B) color.

Figure 5:
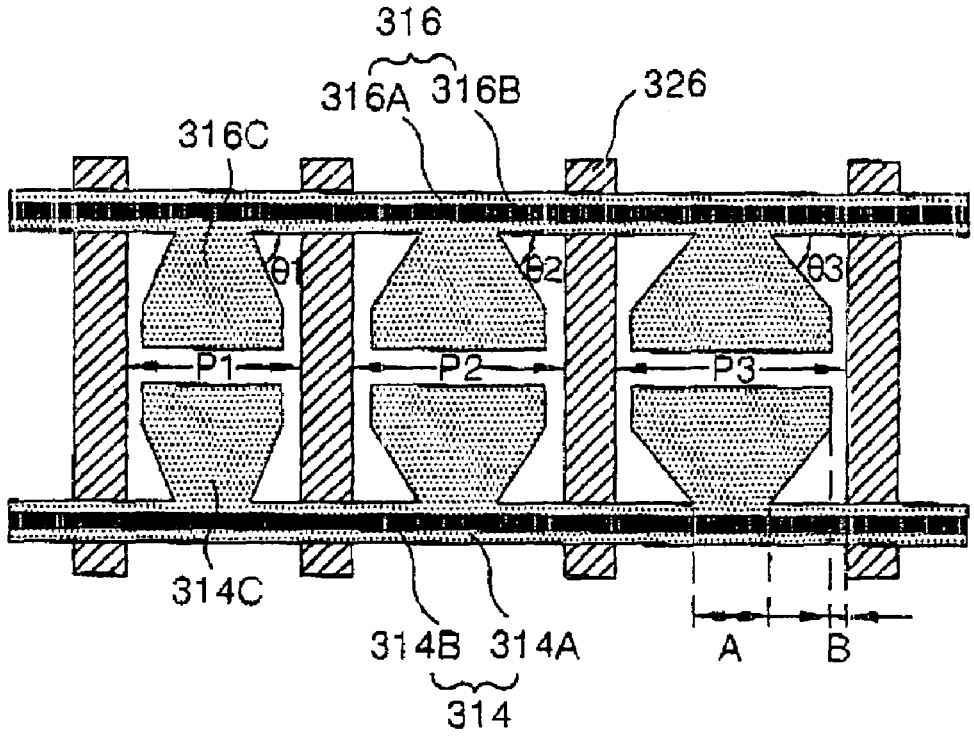
FIG. 5 is a plan view illustrating an electrode structure of a plasma display panel according to a third embodiment of the present invention.

In order to overcome this problem, a PDP according to a third embodiment of the present invention provides red(R), green(G) and blue(B) discharge cells in an asymmetrical shape as shown in FIG. 5 to change an area ratio of the red(R), green(G) and blue(B) discharge cells, thereby compensating fear color co-ordinates according to a change in the emission area.

More specifically, the PDP according to the third embodiment of the present invention has the same elements as the PDP according to the first embodiment of the present invention shown in FIG. 3 except for barrier ribs 326 and a sustain electrode pair 314 and 316. An explanation as to other elements excluding the barrier ribs 326 and the sustain electrode pair 314 and 316 in the PDP according to the third embodiment of the present invention will be replaced by the foregoing descriptions of the PDP according to the first embodiment of the present invention shown in FIG. 3.

Each of the barrier ribs 326 in the PDP according to the third embodiment of the present invention is provided among red(R), green(G) and blue(B) discharge cells to separate adjacent discharge cells. In this case, if it is assumed that a distance between the barrier ribs 326 for separating the red(R) discharge cell should be 'P1'; a distance between the barrier ribs 326 for separating the green(G) discharge cell should be 'P2'; and a distance between the barrier ribs 326 for separating the blue(B) discharge cell should be 'P3', then relationship among P1, P2 and P3 becomes P1<P2<P3. In other words, an area of each discharge cell becomes large in a sequence of blue(B), green(G) and red(R) colors depending upon emission brightness characteristics of the red(R), green(G) and blue (B) colors. Accordingly, a distance between the barrier ribs 326 for separating the red(R), green(G) and blue(B) discharge cells is formed in an asymmetrical shape to change an area ratio of the red(R), green(G) and blue(B) discharge cells, thereby differentiating an emission area to compensate for color co-ordinates and emission brightness.

In the PDP according to the third embodiment of the present invention, the sustain electrode pair 314 and 316 consist of a scan electrode and a sustain electrode. The scan electrode 314 is mainly supplied with a scanning signal for a panel scanning and a sustaining signal for a discharge sustaining, whereas the sustain electrode 316 is mainly supplied with a sustaining signal.

Each of the sustain electrode pair 314 and 316 is comprised of stripe-shaped transparent electrodes 314A and 316A having a relatively large width and made from a transparent electrode material (e.g., ITO) to transmit a visible light, protruded transparent electrodes 314C and 316C protruded in a trapezoidal shape from the transparent electrodes 314A and 316A and further protruded in a square shape therefrom, and metal electrodes 314B and 316B having a relatively small width to compensate for resistance components of the transparent electrodes 314A and 316A. In this case, the transparent electrodes, 314A and 316A of the sustain electrode pair 314 and 316 are opposed to each other with having a gap of approximately 60 μm to 80 μm therebetween.

The protruded transparent electrodes 314C and 316C remove an ineffective electrode portion at which discharge efficiency within the discharge call is deteriorated to thereby improve discharge efficiency and brightness, and reduce areas of the respective transparent electrodes 314A and 316A to thereby reduce power consumption. To this end, the protruded transparent electrodes 314C and 316C are protruded in a trapezoidal shape from the respective transparent electrodes 314A and 316A and further protruded in a square shape therefrom. In other words, side surfaces of the protruded transparent electrodes 314C and 316C are spaced, by a gap B of approximately 10 μm to 50 μm, from each other by the barrier ribs 326. The protruded electrodes 314C and 316C have a predetermined width at the middle portions of the respective transparent electrodes 314A; and 316A, and have a larger width as they go into a gap portion by which the scan electrode 314 and the sustain electrode 316 are opposed to each other. Thus, in the protruded transparent electrodes 314C and 316C protruded at the middle portions of the respective transparent electrodes 314A and 316A, since a width A of a contact point protruded from the transparent electrodes 314A and 316A is different from a width of the gap portion by which the scan electrode 314 and the sustain electrode 316 are opposed to each other, each of the protruded transparent electrodes 314C and 316C has predetermined angles θ3, θ2 and θ1 at the contact point. Herein, the predetermined angles θ3, θ2 and θ1 are defined constantly in accordance with a size in widths of the protruded transparent electrodes 314C and 316C protruded from the contact point to be differentiated depending upon an asymmetry ratio of the discharge cells. As a result, the blue(B) discharge cell with a largest asymmetry ratio has a smallest value θ3 while the red(R) discharge cell with a smallest asymmetry ratio has a largest value θ1.

The PDP according to the third embodiment of the present invention defines a distance between the barrier ribs 326 for separating the red(R), green(G) and blue(B) discharge cells in an asymmetrical shape to change an area ratio of the red(R), green(G) and blue(B) discharge cells, thereby differentiating an emission area to (compensate for color co-ordinates and emission brightness. Furthermore, the PDP according to the third embodiment of the present invention widens the electrode areas of the transparent electrodes 314A and 316A to thereby raise brightness, and removes a portion of the transparent electrodes 314A and 316A from the peripheral portion having discharge efficiency more deteriorated than the middle portion within the discharge cell to thereby reduce power consumption. As a result, the. PDP according to the third embodiment of the present invention can not only improve discharge efficiency and brightness, but also it can reduce power consumption.

Figure 6:
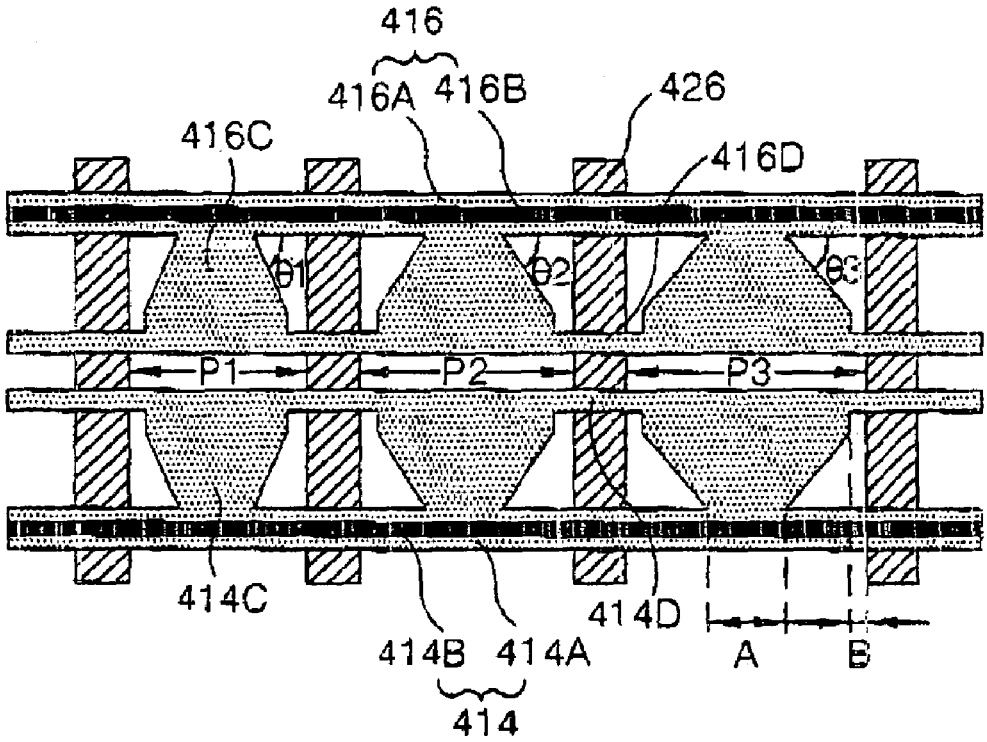
FIG. 6 is a plan view illustration, an electrode structure of a plasma display panel according to a fourth embodiment of the present invention.

Referring to FIG. 6, a PDP according to a fourth embodiment of the present invention has the same elements as the PDP according to the third embodiment of the present invention shown, in FIG. 5 except for connectors 414D and 416D for connecting protruded transparent electrodes 414C and 416C of adjacent discharge cells to each other. Thus, an explanation as to other elements excluding the connectors 414D arid 416D will be replaced by the foregoing descriptions of the PDP according to the third embodiment of the present invention shown in FIG. 5.

The connectors 414D and 416D in the PDP according to the fourth embodiment of the present invention connects the ends of adjacent protruded transparent electrodes 414C and 416C protruded in a square shape to each other, respectively. In other words, the connectors 414D and 416D have a smaller width than adjacent protruded transparent electrodes 414C and 416C protruded in a square shape. Thus, the ends of the protruded transparent electrodes 414C and 416C connected to each other by the respective connectors 414D and 416D results in a stripe shape to be in parallel to the respective transparent electrodes 414A and 416A.

Each of such connectors 414D and 416D allows a discharge current to be applied via any at least one of adjacent protruded transparent electrodes 414C and 416C even though any one of the protruded transparent electrodes 414C and 426C is disconnected due to an alien substance or an air bubble, etc. upon patterning of a transparent electrode material of a glass working step in the fabrication process of the PDP. In other words, a discharge current is applied from the protruded transparent electrodes 414C and 416C of other discharge cell, via the connectors 414D and 416D, to the protruded transparent electrodes 414C and 416C disconnected by a cell badness caused by an alien substance or an air bubble, etc. in the course of the fabrication process of the PDP. Accordingly, the PDP according to the fourth embodiment of the present invention connects the protruded transparent electrodes 414C and 416C provided within adjacent two discharge cells to each other by the connectors 414D and 416D, thereby preventing a non-discharge caused by a cell badness occurring in the course of the PDP fabrication process.

The PDP according to the fourth embodiment of the present invention widens the electrode areas of the transparent electrodes 414A and 416A to thereby raise brightness, and removes a portion of the transparent electrodes 414A and 416A from the peripheral portion having discharge efficiency more deteriorated than the middle portion within the discharge cell to thereby reduce power, consumption. As a result, the PDP according to the fourth embodiment of the present invention can not only improve discharge efficiency and brightness, but also it can reduce power consumption.

Furthermore, the PDP according to the fourth embodiment of the present invention defines a distance between the barrier ribs 326 for separating the red(R), green(G) and blue(B) discharge cells in an asymmetrical shape to change an area ratio of the red(R), green(G) and blue(B) discharge cells, thereby differentiating an emission area to compensate for color co-ordinates and emission brightness. Moreover, the PDP according to the fourth embodiment of the present invention connects the protruded transparent electrodes 414C and 416C provided within adjacent two discharge cells to each other by the connectors 414D and 416D, thereby preventing a non-discharge caused by a cell badness occurring in the course of the PDP fabrication process.

Figure 7:
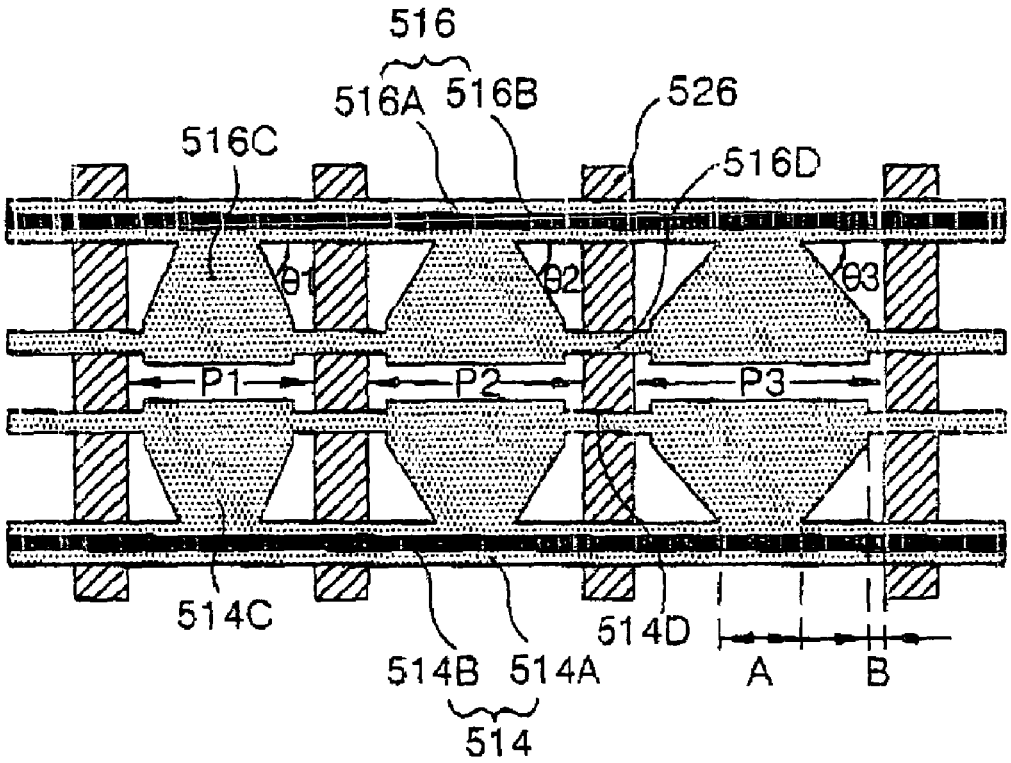
FIG. 7 is a plan view illustrating an electrode structure of a plasma display panel according to a fifth embodiment of the present invention.

Referring to FIG. 7, a PDP according to a fifth embodiment of the present invention has the same elements as the PDP according to the third embodiment of the present invention shown in FIG. 5 except for connectors 514D and 516D for connecting protruded transparent electrodes 514C and 516C of adjacent discharge cells to each other. Thus, an explanation as to other elements excluding the connectors 514D and 516D will be replaced by the foregoing descriptions of the PDP according to the third embodiment of the present invention shown in FIG. 5.

The connectors 514D and 516D in the PDP according to the fifth embodiment of the present invention connects the inner sides with a predetermined distance at the ends of adjacent protruded transparent electrodes 514C and 516C protruded in a square shape to each other, respectively. In other words, the connectors 514D and 516D have a smaller width than adjacent protruded transparent electrodes 514C and 516C protruded in a square shape.

Each of such connectors 514D and 516D allows a discharge current to be applied via any at least one of adjacent protruded transparent electrodes 514C and 516C even though any one of the protruded transparent electrodes 514C and 516C is disconnected due to an alien substance or an air bubble, etc. upon patterning of a transparent electrode material of a glass working step in the fabrication process of the PDP. In other words, a discharge current is applied from the protruded transparent electrodes 514C and 516C of other discharge cell, via the connectors 514D and 516D, to the protruded transparent electrodes 514C and 516C disconnected by a cell badness caused by an alien substance or an ar bubble, etc. in the course of the fabrication process of the PDP. Accordingly, the PDP according to the fifth embodiment of the present invention connects the protruded transparent electrodes 514C and 516C provided within adjacent two discharge cells to each other by the connectors 514D and 516D, thereby preventing a non-discharge caused by a cell badness occurring in the course of the PDP fabrication process.

Furthermore, the connectors 514D and 516D are provided at the inner side with a predetermined distance a from the protruded transparent electrodes 514C and 516, so that lengths of the opposite surfaces between the protruded transparent electrodes 514C and 516C opposed to each other with having a predetermined gap therebetween at a single of discharge cell, thereby reducing a black brightness as mentioned above.

The PDP according to the fifth embodiment of the present invention widens the electrode areas of the transparent electrodes 514A and 516A to thereby raise brightness, and removes a portion of the transparent electrodes 514A and 516A from the peripheral portion having discharge efficiency more deteriorated than the middle portion within the discharge cell to thereby reduce power consumption. As a result, the PDP according to the fifth embodiment of the present invention can not only improve discharge efficiency and brightness, but also it can reduce power consumption.

In addition, the PDP according to the fifth embodiment of the present invention defines a distance between the barrier ribs 326 for separating the red(R) green(G) and blue(B) discharge cells in an asymmetrical shape to change an area ratio of the red(R), green(G) and blue(B) discharge calls, thereby differentiating an emission area to compensate for color coordinates and emission brightness. Moreover, the PDP according to the fifth embodiment of the present invention reduces a black brightness with the aid of the connectors 514D and 516D to thereby improve a contrast ratio, and connects the protruded transparent electrodes 514C and 516C provided within adjacent two discharge cells to each other by the connectors 514D and 516D to thereby prevent a non-discharge caused by a tell badness occurring in the course of the PDP fabrication process.

Figure 8:
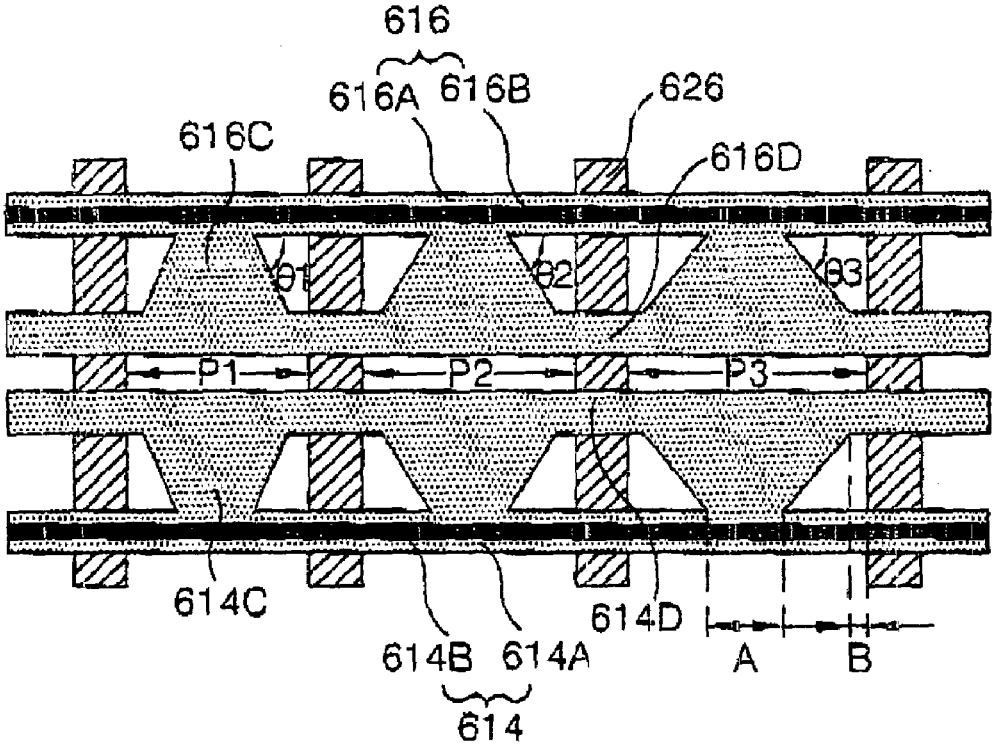
FIG. 8 is a plan view illustrating an electrode structure of a plasma display panel according to a sixth embodiment of the present invention.

Referring to, FIG. 8, a PDP according to a sixth embodiment of the present invention has the same elements as the PDP according to the third embodiment of the present invention shown in FIG. 5 except for connectors 614D and 616D for connecting protruded transparent electrodes 614C and 616C of adjacent discharge cells to each other. Thus, an explanation as to other elements excluding the connectors 614D and 616D will be replaced by the foregoing descriptions of the PDP according to the third embodiment of the present invention shown in FIG. 5.

The connectors 614D and 616D in the PDP according to the sixth embodiment of the present invention connects the side surfaces of adjacent protruded transparent electrodes 614C and 616C protruded in a square shape to each other, respectively. In other words, the connectors 614D and 616D have the same width as adjacent protruded transparent electrodes 614C and 616C protruded in a square shape.

Each of such connectors 614D and 616D allows a discharge current to be applied via any at least one of adjacent protruded transparent electrodes 614C and 616C even though any one of the protruded transparent electrodes 614C and 616C is disconnected due to an alien substance or an air bubble, etc. upon patterning of a transparent electrode material of a glass working step in the fabrication process of the PDP. In other words, a discharge current is applied from the protruded transparent electrodes 614C and 616C of other discharge cell, via the connectors 614D and 616D, to the protruded transparent electrodes 614C and 616C disconnected by a cell badness caused by an alien substance or an air bubble, etc. in the course of the fabrication process of the PDP. Accordingly, the PDP according to the sixth embodiment of the present invention connects the protruded transparent electrodes 514C and 516C provided within adjacent two discharge cells to each other by the connectors 614D and 616D, thereby preventing a non-discharge caused by a cell badness occurring in the course of the PDP fabrication process.

The PDP according to the sixth embodiment of the present invention widens the electrode areas of the transparent electrodes 614A and 616A to thereby raise brightness, and removes a portion of the transparent electrodes 614A and 616A from the peripheral portion having discharge efficiency more deteriorated than the middle portion within the discharge cell to thereby reduce power consumption. As a result, the PDP according to the sixth embodiment of the present invention can not only improve discharge efficiency and brightness, but also it can reduce power consumption.

In addition, the PDP according to the sixth embodiment of the present invention defines a distance between the barrier ribs 326 for separating the red(R), green(G) and blue(B) discharge cells in an asymmetrical shape to change an area ratio of the red(R), green(G) and blue(B) discharge cells, thereby differentiating an emission area to compensate for color co-ordinates and emission brightness. Moreover, the PDP according to the sixth embodiment of the present invention connects the protruded transparent electrodes 614C and 616C provided within adjacent two discharge cells to each other by the connectors 614D and 616D, thereby preventing a non-discharge caused by a cell badness occurring in the course of the PDP fabrication process.

As described above, the PDP according to the present invention removes a portion of the protruded transparent electrodes that does not contribute to any discharge from each discharge cell in such a manner to, have a predetermined angle, and includes the connectors for connecting adjacent protruded transparent electrodes to each other. Accordingly, it becomes possible to reduce power consumption as well as to prevent a non-discharge caused by a disconnection of the transparent electrodes occurring in the course of the fabrication process thereof.

Furthermore, the PDP according to the present invention defines a distance between the barrier ribs for separating each discharge cell in an asymmetrical shape in consideration of an emission brightness characteristic of each discharge cell and reduces a portion of the protruded transparent electrodes that does not contribute to any discharge from each discharge cell in such a manner to have a predetermined angle, so that it car reduce power consumption and can improve brightness.

In addition, the PDP according to the present invention further includes the connectors for connecting the protruded transparent electrodes of adjacent discharge cells to each other. Accordingly, it becomes possible to reduce the opposite length between the opposed transparent electrodes to reduce a black brightness and to prevent an non-discharge caused by a disconnection between the transparent electrodes occurring in the course of the fabrication process thereof.

Although the present invention has been explained by the embodiment, shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A plasma display panel, comprising:

a plurality of discharge cells provided between first and second substrates, wherein a size of adjacent discharge cells is different; and a plurality of pairs of transparent electrodes extending along one of the substrates, wherein each transparent electrode comprises a plurality of protrusion portions, wherein a size of adjacent protrusion portions of the transparent electrode is different, each protrusion portion comprising:

a trapezoidal portion extending from a base portion into a corresponding discharge cell;

a rectangular portion extending from an upper portion of the trapezoidal portion; and connector portions extending from opposite sides of the rectangular portion and configured to connect respective rectangular portions of adjacent protrusion portions.

2. The plasma display panel as claimed in claim 1, further comprising:

a plurality of barrier ribs configured to separate adjacent discharge cells; and metal electrodes provided on each of the transparent electrodes.

3. The plasma display panel as claimed in claim 2, wherein a distance between each protrusion portion and its respective barrier rib is between approximately 10 μm and 10 μm.

4. The plasma display panel as claimed in claim 1, wherein each connector portion extends toward a respective edge of the discharge cell from a respective end of the rectangular portion of the transparent electrode.

5. The plasma display panel as claimed in claim 1, further comprising a cavity in which a corresponding portion of the transparent electrode is removed between adjacent protrusion portions, said cavity extending between adjacent discharge cells.

6. The plasma display panel as claimed in claim 1, wherein the connector portions extend between adjacent discharge cells.

7. The plasma display panel as claimed in claim 1, wherein a width of each connector portion is substantially the same as a width of corresponding rectangular portions from which it extends.

8. The plasma display panel as claimed in claim 1, wherein a width of each connector portion is less than a width of corresponding rectangular portions from which it extends.

9. The plasma display panel as claimed in claim 8, wherein ends of each connector portion and ends of the corresponding rectangular portions from which each connector portion extends form stepped portions.

10. The plasma display panel as claimed in claim 1, wherein an angle formed between the trapezoidal portion and the base portion of the transparent electrode is different in adjacent discharge cells.

11. The plasma display panel as claimed in claim 10, wherein the angle between the trapezoidal portion and the base portion of the transparent electrode in a blue discharge cell is greater than said angle in an adjacent green discharge cell, and said angle in a green discharge cell is greater than said angle in an adjacent red discharge cell.

12. The plasma display panel as claimed in claim 1, wherein a size of a blue discharge cell and its corresponding protrusion portion is greater than a size of an adjacent green discharge cell and its corresponding protrusion portion, and wherein a size of a green discharge cell and its corresponding protrusion portion is greater than a size of an adjacent red discharge cell and its corresponding protrusion portion.

13. A plasma display panel, comprising:

a plurality of barrier ribs asymmetrically defining a size of red, green and blue discharge cells;

pairs of transparent electrodes formed in a strip shape at each discharge cell; and protruded transparent electrodes protruding from each of the transparent electrodes with a structure in which a square shape is connected to a trapezoidal shape, wherein an angle between the trapezoidal shaped portion and the striped shaped portion of the transparent electrode is different in adjacent discharge cells.

14. The plasma display panel as claimed in claim 13, wherein the plurality of barrier ribs are arranged substantially perpendicular to the pairs of transparent electrodes.

15. The plasma display panel as claimed in claim 14, wherein each of the discharge cells are substantially rectangular.

16. The plasma display panel as claimed in claim 14, wherein a width of the connection portion is less than a width of its corresponding rectangular portions from which it extends.

17. The plasma display panel as claimed in claim 14, wherein a width of each connection portion is substantially the same as a width of its corresponding rectangular portions from which it extends.

18. The plasma display panel as claimed in claim 14, wherein said angle is reduced in a sequence of the red, green and blue discharge cells.

19. The plasma display panel as claimed in claim 13, wherein the angle between the trapezoidal portion and the base portion of the transparent electrode in a blue discharge cell is greater than said angle in an adjacent green discharge cell, and said angle in a green discharge cell is greater than said angle in an adjacent red discharge cell.

20. The plasma display panel as claimed in claim 13, wherein a size of a blue discharge cell and its corresponding protrusion portion is greater than a size of an adjacent green discharge cell and its corresponding protrusion portion, and wherein a size of a green discharge cell and its corresponding protrusion portion is greater than a size of an adjacent red discharge cell and its corresponding protrusion portion.

21. The plasma display panel as claimed in claim 13, further comprising connection portions which extend from the square shaped portions between adjacent discharge cells so as to connect adjacent protruded transparent electrodes.

22. A plasma display panel, comprising:

a plurality of discharge cells provided between first and second substrates; and a plurality of pairs of transparent electrodes extending along one of the substrates, wherein each transparent electrode comprises a plurality of protrusion portions, each protrusion portion comprising:

a trapezoidal portion extending from a base portion into a corresponding discharge cell, wherein an angle formed between the trapezoidal portion and the base portion of the transparent electrode is different in adjacent discharge cells;

a rectangular portion extending from an upper portion of the trapezoidal portion; and connector portions extending from opposite sides of the rectangular portion and configured to connect respective rectangular portions of adjacent protrusion portions.

* * * * *